US005208934A

United States Patent [19]

Bachnick et al.

[11] Patent Number: 5,208,934

[45] Date of Patent: May 11, 1993

[54] COVER FOR A PILLOW OR DUVET FOR A CHILD'S BED

[76] Inventors: Martina Bachnick; Arnfried Maaser, both of Herbertstrasse 3, D-1000 Berlin 62, Fed. Rep. of Germany

[21] Appl. No.: 773,856

[22] PCT Filed: Apr. 25, 1990

[86] PCT No.: PCT/DE90/00311

§ 371 Date: Oct. 24, 1991

§ 102(e) Date: Oct. 24, 1991

[87] PCT Pub. No.: WO90/12527

PCT Pub. Date: Nov. 1, 1990

[30] Foreign Application Priority Data

Apr. 25, 1989 [DE] Fed. Rep. of Germany ... 8905368[U]

[51] Int. Cl.[5] ..... A47C 9/00; A63H 3/00

[52] U.S. Cl. ..... 5/482; 5/490; 446/73; 446/369

[58] Field of Search ..... 5/482, 485, 490; 446/73, 74, 369

[56] References Cited

U.S. PATENT DOCUMENTS

| | | | |
|---|---|---|---|
| 1,867,422 | 7/1932 | Shapiro | 5/490 X |
| 4,590,633 | 5/1986 | Pickens . | |
| 4,750,225 | 6/1988 | Simons et al. | 5/485 |
| 4,890,347 | 1/1990 | Fuller | 5/482 X |
| 5,084,930 | 2/1992 | Danova | 446/73 X |

FOREIGN PATENT DOCUMENTS

| | | |
|---|---|---|
| 432869 | 12/1911 | France . |
| 2182117 | 12/1973 | France . |
| 2173095 | 10/1986 | United Kingdom . |

*Primary Examiner*—Michael F. Trettel
*Attorney, Agent, or Firm*—Mark P. Stone

[57] ABSTRACT

The present invention is directed to a bedspread cover for a child's bed having a toy preferably in the form of an animal or doll attached to the cover. The toy is formed from a first substantially two-dimensional portion and a second three-dimensional pillow like portion. At least the three-dimensional portion of the toy, which is preferably formed as the head of the toy, is removably attached to the bedspread cover and extends beyond an upper end of the cover. The cover can include a pocket for removably receiving the bottom of the planar portion of the toy for further securing the toy to the bedspread cover.

10 Claims, 1 Drawing Sheet

COVER FOR A PILLOW OR DUVET FOR A CHILD'S BED

BACKGROUND OF THE INVENTION

The invention concerns a cover for a pillow or duvet for a child's bed.

Before they fall asleep children like to have a cuddly toy with them, in the shape of an animal or a doll either to cuddle on it or to have it above the pillow. They often use one of those figures they play with during the daytime. This has hygienic disadvantages.

The primary object of the present invention is to eliminate such hygienic disadvantages.

SUMMARY OF THE INVENTION

The object of the invention is achieved by providing cuddly toy in the shape of an animal or doll located at one side and at the upper end of a cover with the head of the toy projecting like a cushion wholly or partly beyond the upper end of the cover and with the remaining portion of the toy being substantially two-dimensional integrated with the upper surface of the cover in such a way the it remains visible. At least that part of the toy that projects beyond the upper end of the cover is detachably fixed to the cover.

The portion of the toy figure that is detachably fixed on the cover is not used by the child for play during the daytime and therefore will not be soiled. Another advantage of the invention is that the attachment formed by the figure on the cover warms the child up in a better way than a usual cuddly toy. Furthermore children have a tendency to embrace the pillow-like attachment which counteracts a kicking off of the duvet. At least the part of the figure that projects beyond the cover is separable from the cover and advantageously can be removed from the cover to permit washing the cover without any problems: normally it is washed at relatively high temperatures (60–96 degrees) which is harmful for the pillow-like attached part and the whole figure respectively.

The figure is preferably washed at 30–40 degrees. Additionally the cover can be ironed easily if the part of the toy that projects beyond the cover is removable. The removable part can be replaced as necessary because of hygienic reasons. Finally, a manufacturing of a cover with a figure is easier due to the separability of the pillow-like attachment or the whole figure respectively.

The aforementioned substantially two dimensional portion of the figure that does not extend beyond the cover can be designed like a relief or be printed on the cover.

providing the whole figure separably fixed on the cover is advantageous. It could be homogeneously shaped, i.e. as a flat design at least for the range of the cover that preferably extends vertically to a flat design near the attachment. In this case the aforementioned advantages concerning the manufacturing of the cover according to the invention, and washing and the ironing the cover are realized.

Furthermore it is suitable if elements for attaching either a part of the figure or of the whole figure are provided on both sides of the cover. In this way it is possible to fix the figure either on one side or on the other, no matter which side is preferred. It is also possible to fix two figures on the cover.

At least one pocket, preferably two pockets, are formed above the bedspread cover in the range of the the portion of the figure that does not extend beyond the cover, preferably in the middle range, one pocket on each side whose opening ( openings ) is ( are ) situated near the sides of this portion of the figure. Such pocket can serve to store something, e.g. a handkerchief. The child can also keep its' hands warm in it.

It is also suitable to fix a further pocket in a separable way on the cover of the duvet near the bottom of the figure, i.e. the figure's foot. This pocket should at least cover the range of the foot to further secure the figure to the cover. Of course an attachable pocket can be provided for the figure on both sides.

BRIEF DESCRIPTION OF THE DRAWINGS

Further details of the invention will be become apparent from the drawings in which.

DESCRIPTION OF THE BEST MODES FOR CARRYING OUT THE INVENTION

Figure 2:
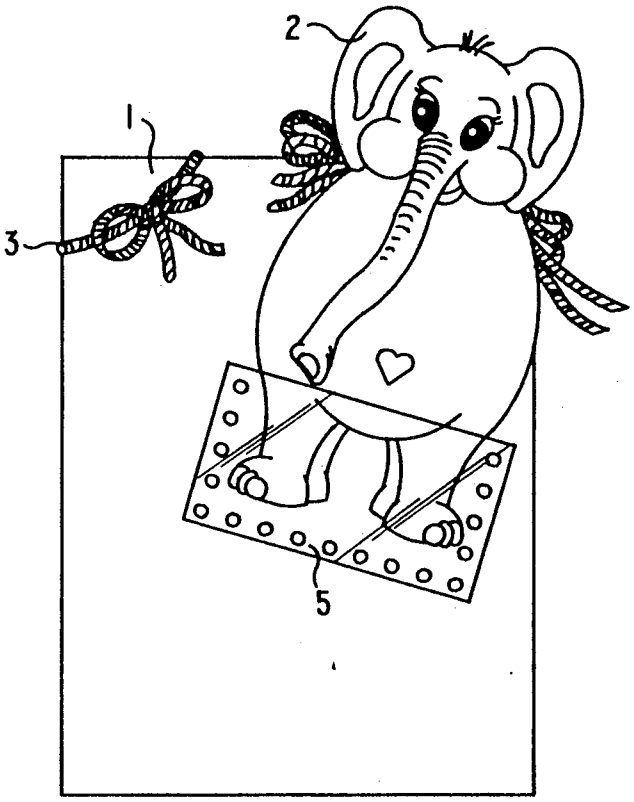
FIG. 2 illustrates a combination of both the cover and the figure according to the invention.

In both drawing figures numeral 1 designates a bedspread cover, numeral 2 designates the figure of an elephant, numeral 3 designates ribbons on the bedspread cover, numeral 4 designates ribbons on the figure and numeral 5 designates a pocket that is separably fixed on bedspread cover 1.

Figure 1:
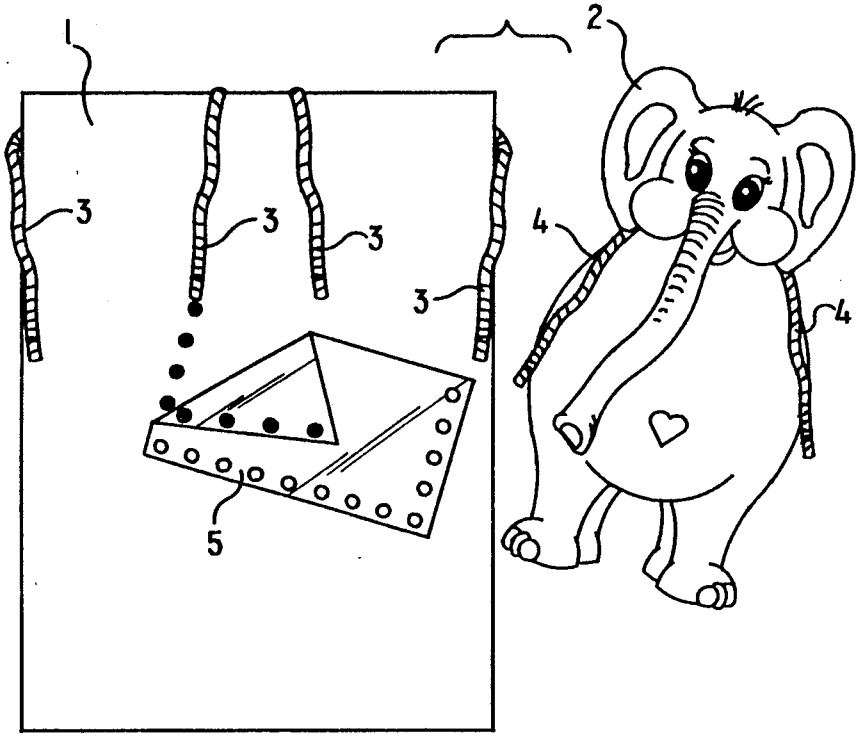
FIG. 1 illustrates a bedspread cover and the figure of an elephant separated from the cover.

FIG. 1 shows both parts, the bedspread cover and the figure, separated from each other; FIG. 2 shows these parts when they are joined together. On the one hand, FIG. 2 is removably attached to the bedspread cover 1 by the ribbons 3 and 4. On the other hand, the figure's feet are received in pocket 5 and in this way are secured to the bedspread cover.

Other attachment elements can be used, such as press fasteners, buttons or bur ribbons.

Pillows that only consist of one cover are within the scope of the present invention and one filling and quilts with only one unseparable cover.

The invention also encompasses a figure that does not only project beyond the cover with its head but also with a part of its upper body.

"Basically two-dimensional", as used herein, means that the figure in the range of the cover is at the most as thick as wide, though preferably considerably flatter.

We claim:

1. A bedspread cover having a toy attached thereto; said toy including a first substantially two dimensional portion and a second three dimensional pillow-like portion; said toy being attached to said bedspread cover such that at least a major part of said substantially two dimensional portion of said toy does not extend beyond an edge of said bedspread cover, and said three dimensional portion of said toy extends beyond said edge of said bedspread cover; and means for removably attaching at least said three dimensional portion of said toy to said bedspread cover.

2. The bedspread cover as claimed in claim 1 wherein said toy is attached to said bedspread cover such that no part of said substantially two dimensional portion of said toy extends beyond said edge of said bedspread cover.

3. The bedspread cover as claimed in claim 2 wherein said toy includes a head and said head comprises said three dimensional portion of said toy.

4. The bedspread cover as claimed in claim 3 wherein said edge is an upper edge of said bedspread cover.

5. The bedspread cover as claimed in claim 1 wherein said means for removably attaching said three dimensional portion of said toy is said bedspread cover includes cooperating attachment means on both said bedspread cover and said three dimensional portion of said toy.

6. The bedspread cover as claimed in claim 1 further including means for removably attaching the entire toy to said bedspread cover.

7. The bedspread cover as claimed in claim 1 wherein said bedspread cover has a top surface and a bottom surface, and said means for removably attaching said three dimensional portion of said toy are provided on both said top and bottom surfaces.

8. The bedspread cover as claimed in claim 7 wherein said bedspread cover includes means for removably attaching the entire toy to both said top and bottom surfaces of said bedspread cover.

9. The bedspread cover as claimed in claim 1 further including at least one pocket thereon, said at least one pocket provided for removably receiving a bottom part of said substantially two dimensional portion of said toy for further securing said toy to said bedspread cover.

10. The bedspread cover as claimed in claim 9 further including means for removably mounting said pocket to said bedspread cover.

* * * * *